United States Patent [19]

Van Dongen et al.

[11] Patent Number: 4,836,301

[45] Date of Patent: Jun. 6, 1989

[54] METHOD AND APPARATUS FOR DIRECTIONAL DRILLING

[75] Inventors: Johannes C. M. Van Dongen; Robert N. Worrall, both of Rijswijk, Netherlands

[73] Assignee: Shell Oil Company, Houston, Tex.

[21] Appl. No.: 50,975

[22] Filed: May 15, 1987

[30] Foreign Application Priority Data

May 16, 1986 [GB] United Kingdom ..... 8612018

[51] Int. Cl.[4] ..... E21B 7/08

[52] U.S. Cl. ..... 175/61; 175/73; 175/74; 175/256

[58] Field of Search ..... 175/61, 73, 74, 107, 175/256, 323, 355, 393

[56] References Cited

U.S. PATENT DOCUMENTS

| | | | |
|---|---|---|---|
| 2,919,897 | 1/1960 | Sims | 255/1.6 |
| 3,586,116 | 6/1971 | Tiraspolsky et al. | 175/74 |
| 3,667,556 | 6/1972 | Henderson | 175/73 |
| 4,465,147 | 8/1984 | Feenstra et al. | 175/73 |
| 4,485,879 | 12/1984 | Kamp et al. | 175/61 |
| 4,492,276 | 1/1985 | Kamp | 175/61 |
| 4,522,272 | 6/1985 | Beimgraben | 175/74 |
| 4,637,479 | 1/1987 | Leising | 175/61 X |
| 4,655,299 | 4/1987 | Schoeffler | 175/61 X |

*Primary Examiner*—William P. Neuder

[57] ABSTRACT

A method of directionally drilling a borehole makes use of a drilling assembly including an apparatus having an upper section with a longitudinal axis I, and a lower section having a central axis II and including at least part of a rotary drill bit, said sections being interconnected by a universal pivot mechanism. The method comprises rotating the assembly in such a manner that the upper section rotates about said longitudinal axis I and the lower section rotates about said central axis II. During at least part of the drilling operations said central axis II is tilted and rotated in an orbital mode relative to said longitudinal axis I such that a plane containing said two axes is maintained in a predetermined orientation relative to a reference direction.

32 Claims, 7 Drawing Sheets

METHOD AND APPARATUS FOR DIRECTIONAL DRILLING

BACKGROUND OF THE INVENTION

The invention relates to a method and apparatus for directionally drilling a borehole in subsurface earth formations.

During the course of drilling operations it is frequently necessary to change the direction of drilling. By use of directional drilling techniques changing the direction of drilling is usually achieved by drilling a curved borehole section until the borehole is at the desired course, whereupon drilling in a straight direction is continued. Numerous attempts have already been made to provide directional drilling methods whereby the course of drilling may be changed without interrupting drilling. U.S. Pat. No. 2,919,897 describes a drilling assembly comprising a stabilizer that can be brought from a concentric to an excentric position relative to the drill string. The stabilizer can be maintained either in the eccentric or in the concentric position thereof in a fixed orientation in the borehole so that curved and straight borehole sections can be drilled at will.

U.S. Pat. No. 3,667,556 describes a downhole drilling motor of which the output shaft is supported by a bearing which is attached in a pivotable manner to the motor housing. During drilling the housing is kept stationary in the borehole and by pivoting the bearing the bit can be put in a tilted position in the borehole so that the direction of drilling may be varied continuously without interrupting drilling operations.

SUMMARY OF THE INVENTION

The invention aims to provide an improved method and apparatus for directional drilling using a drill bit which is connected to the lower end of a drilling string.

The method according to the invention utilizes a drilling assembly including an apparatus having an upper section with a longitudinal axis, and a lower section having a central axis and including at least part of a rotary drill bit, said sections being interconnected by a universal pivot mechanism.

The method comprises rotating the assembly in such a manner that the upper section rotates about said longitudinal axis and the lower section rotates about said central axis, wherein during at least part of the drilling operations said central axis is tilted and rotated in an orbital mode relative to said longitudinal axis such that a plane containing said two axes is maintained in a predetermined orientation relative to a reference direction.

The apparatus according to the invention comprises an upper section having a longitudinal axis and being suitable to be coupled at the lower end of a rotating drill string; a lower section having a central axis and including or being suitable for including at least part of a rotary drill bit; and a universal pivot mechanism interconnecting said two sections in such a manner that upon pivoting of the mechanism during drilling said central axis of the lower section is pivoted over a small angle relative to longitudinal axis of the upper section.

The apparatus further comprises steering means for rotating the central axis of said lower section in an orbital mode relative to the longitudinal axis of the upper section and for simultaneously maintaining said central axis in a predetermined orientation relative to a reference direction.

A BRIEF DESCRIPTION OF THE DRAWINGS

The invention will now be explained in more detail, by way of example, with reference to the accompanying drawings, in which.

Figure 4:
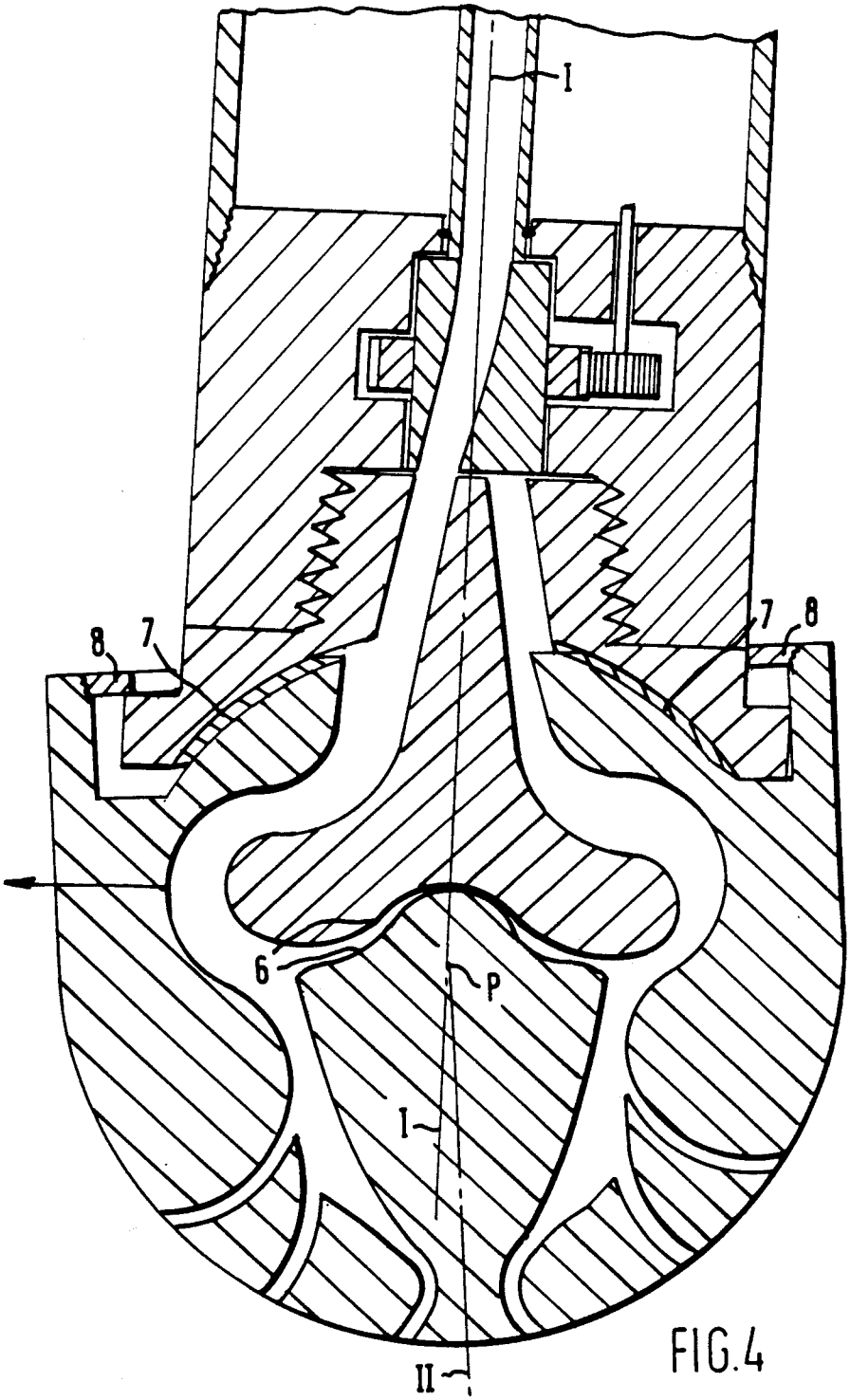
Figure 5:
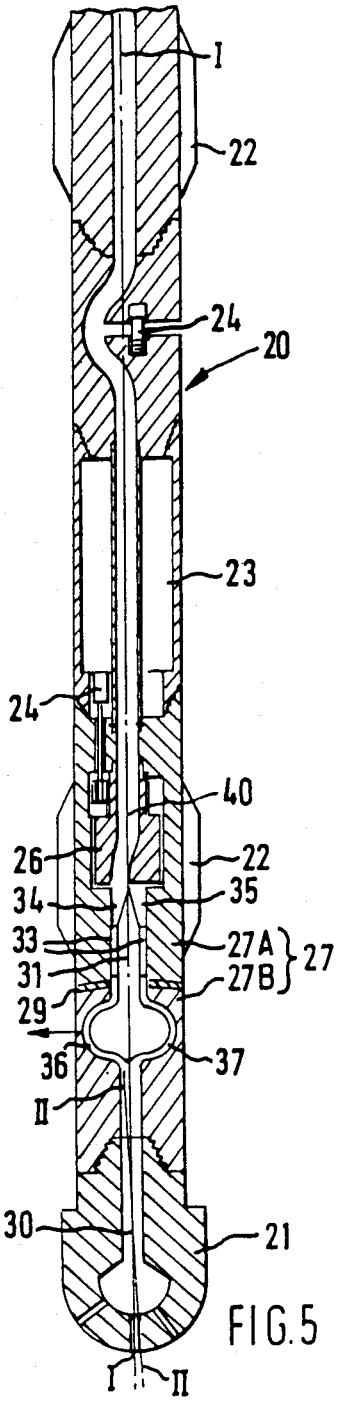
Figure 6:
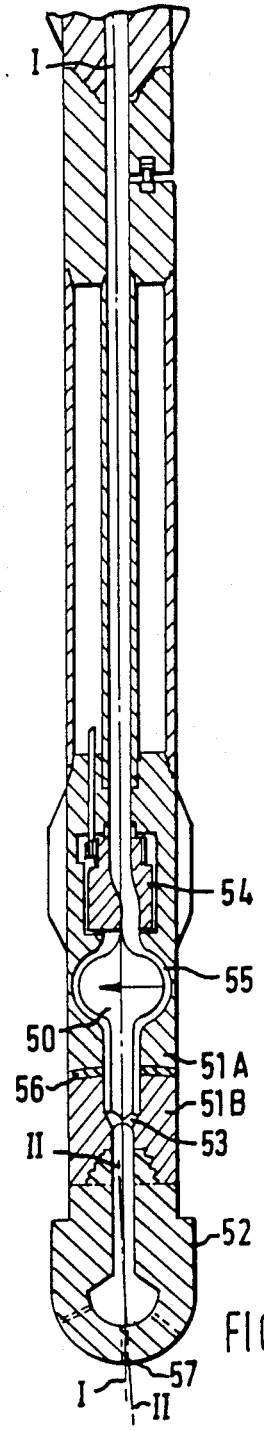
Figure 7:
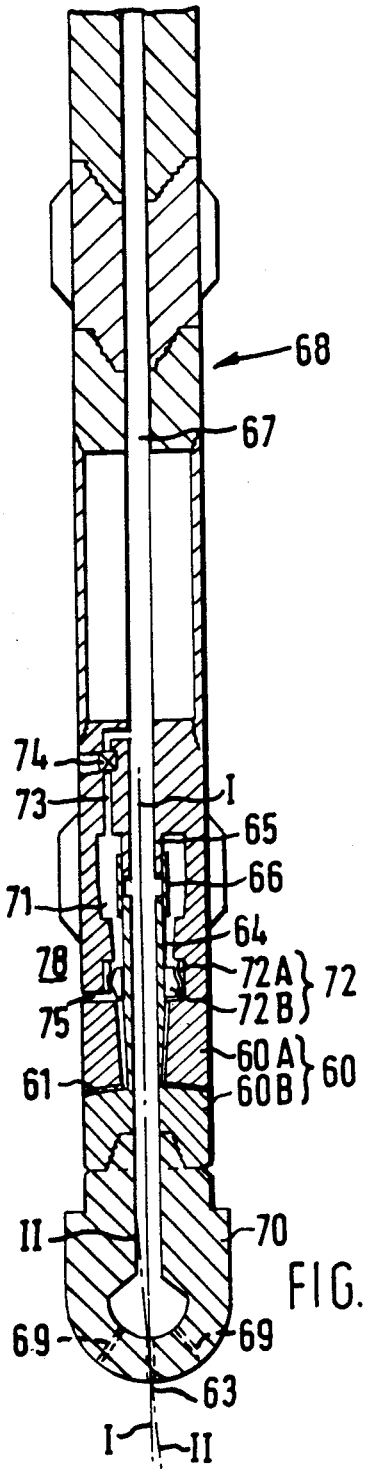
Figure 8:
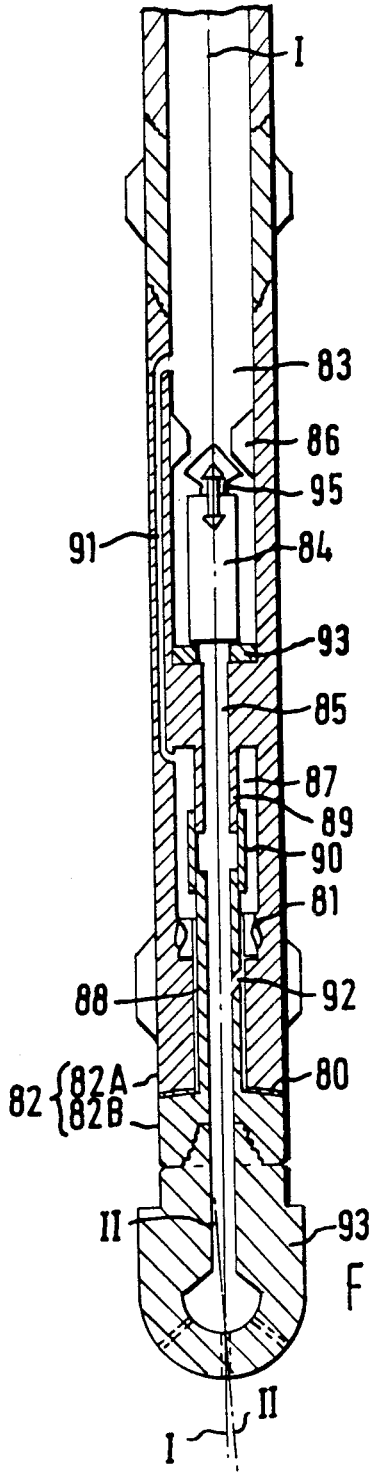
Figure 9:
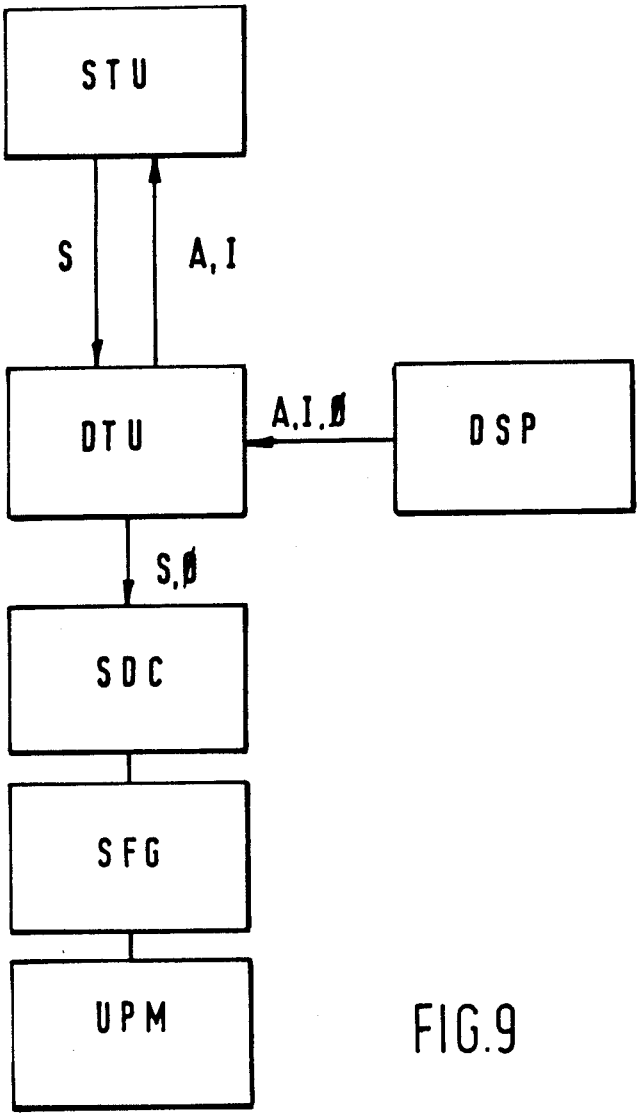

FIG. 4. is a cross sectional view of a bit with a pivot assembly having a pivot center above the bit face;

FIG. 5. is a cross sectional view of a hydrodynamic steering force mechanism and pivot assembly bearing mounted in the drill string above the bit, the hydrodynamic steering force mechanism being located below the pivot assembly;

FIG. 6. is a cross sectional view of a drilling assembly of which the hydrodynamic steering force mechanism is located above the pivot assembly;

FIG. 7 is a cross sectional view of a moineau motor steering mechanism located in a drill string member above the bit, which mechanism is driven by controlled bleeding of part of the drilling fluid into the drillstring formation annulus;

FIG. 8. is a cross sectional view of a moineau motor steering mechanism of which the driving fluid is returned to the interior of the drill string; and FIG. 9. illustrates in a block diagram a suitable embodiment of the steering control system.

DETAILED DESCRIPTION OF THE PREFERRED EMBODIMENTS

In each of the figures there is shown a rotary drill bit attached to the bottom of a drill string. During drilling this string may be rotated from surface and/or by a downhole motor or turbine (not shown). The drilling assembly shown in each of the figures includes an apparatus embodying the invention. The apparatus comprises a lower section which has a central axis II and includes at least a lower section of the bit. The apparatus further comprises an upper section which has a longitudinal axis I and includes at least a portion of the drill string. The section are interconnected in such a pivotable manner, that the central axis II relative to the longitudinal axis I may be caused to intersect at a very small angle. The plane containing these two axes I and II, which plane coincides in each of the plane of the drawing, may be held in a predetermined orientation relative to a fixed reference direction as the drill string rotates. A sensor mounted in a direction sensor package DSP (see FIG. 9) above the bit or in the bit senses this fixed magnetic, gyro, gravity highside or other reference direction and a steering direction control (SDC) mechanism controls the rotation of this plane about the string axis in the opposite direction to bit rotation, such that the plane remains stationary with respect to the fixed reference direction.

If during drilling a curved borehole section is to be drilled, for example to reach a target or to compensate for deviation from a desired course, then the central axis II is rotated relative to the longitudinal axis I in such a manner that the axis II is maintained coincident or nearly coincident with the desired direction of the borehole. In the event that the bit axis is nearly coincident with the desired direction of the borehole then the resultant side force imposed on the borehole wall will cause the bit to drill in the desired direction.

If during drilling the steering direction control mechanism is not activated, then the bit axis is allowed to remain concentric with the string axis so that the assembly will drill straight ahead. If the bit axis is varied randomly by the steering direction control mechanism, then the assembly will also drill straight ahead.

Figure 1:
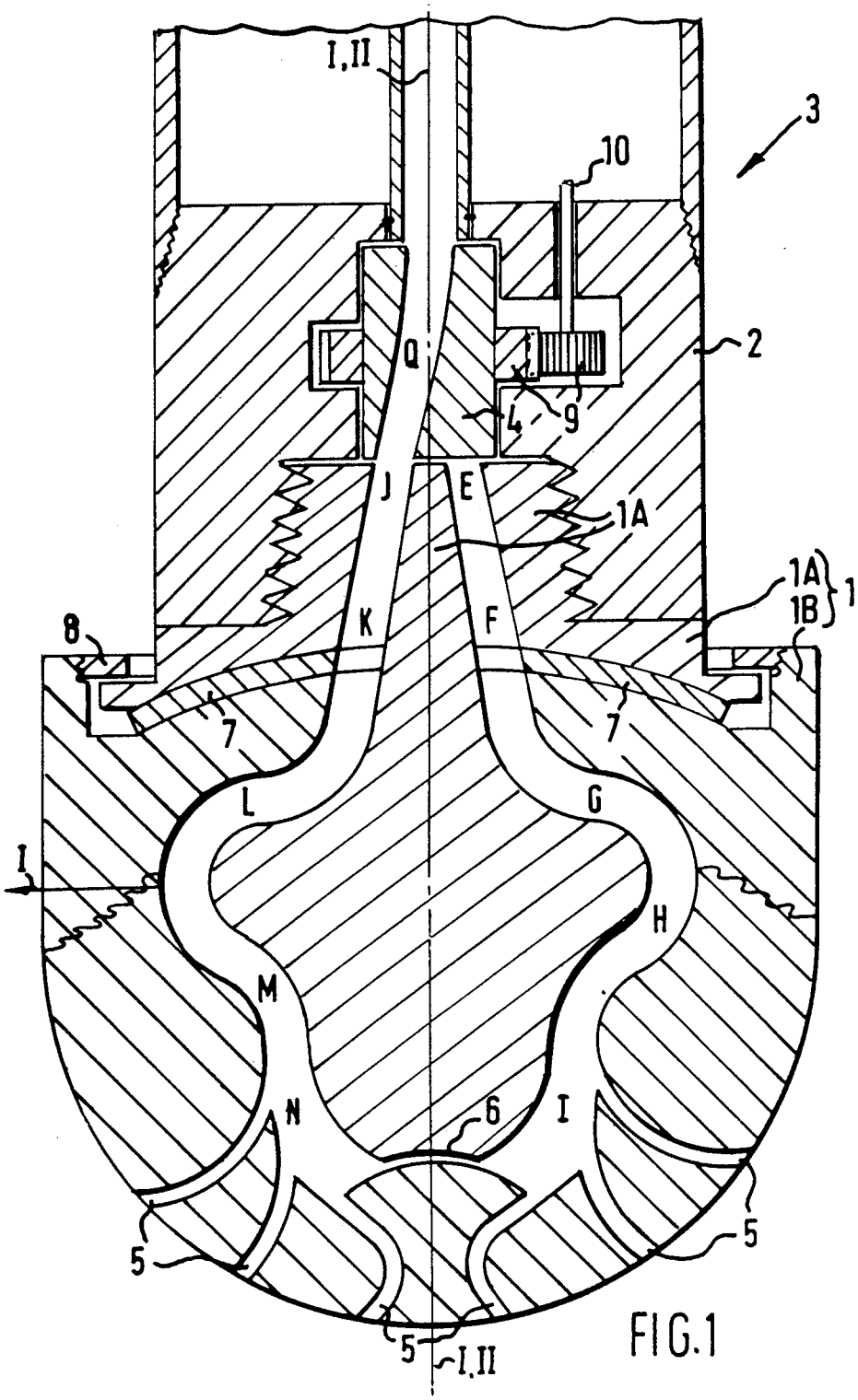
FIG. 1 is a cross sectional view of a steerable bit with a hydrodynamic steering force mechanism and pivot assembly mounted inside the bit.
Figure 2:
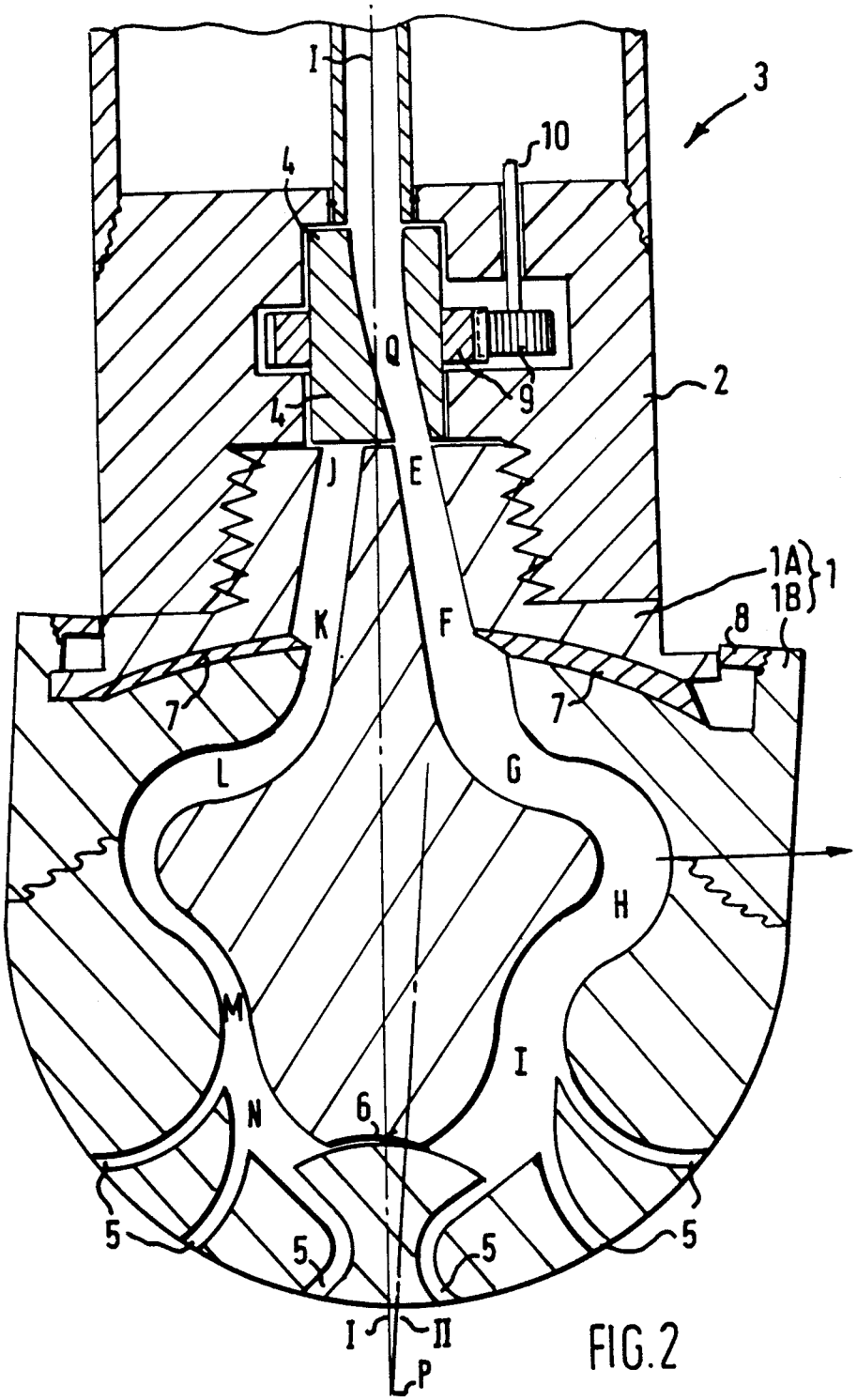
FIG. 2 is a cross sectional view of the bit of FIG. 1. in a tilted position thereof, with a pivot assembly having a pivot center below the bit face.

A special embodiment of the invention is shown in FIG. 1 and 2. These figures show a bit 1 being coupled to the lowermost section 2 of a drill string 3. The bit consists of a bit mandrel 1A and a bit carcass 1B, which are interconnected by means of a universal pivot assembly consisting of a ball-shaped thrust bearing 6 and a spherically-shaped elastomer or other support bearing 7. The support bearing 7 may be provided with radial ribs or splines (not shown) in order to avoid any damage to the elastomer due to the torque transferred via the drill string 3 to the bit 1 during drilling. The bit mandrel 1A forms, together with the lowermost drill string section 2, the upper section of the apparatus of the invention, whereas the bit carcass 1B forms the lower section thereof.

In FIG. 1 the bit 1 is shown in the concentric position thereof, such that the central or bit axis II, which is formed by the axis of symmetry of the bit carcass 1B, coincides with the longitudinal or string axis I of the lowermost drill string section 2 and bit mandrel 1A.

In FIG. 2 the bit of FIG. 1 is shown in the tilted position thereof, such that the bit axis II is oriented at a small angle relative to the drill string axis I. The maximum angle between the bit axis II and string axis I is restricted by a stop shoulder 8 mounted on the bit carcass 1B.

The lowermost drill string section 2 is provided with a hydroynamic steering control mechanism comprising a rotating flow deflector 4 which can be driven to rotate relative to the drill-string 3 about the string axis I by means of a gear wheel mechanism 9. This mechanism may be driven via shaft 10 by a hydraulic, electric or other motor (not shown). The rotating flow deflector 4 is made of wear resistant material and comprises a flow channel Q which communicates at the upper end thereof with the interior of the drill string 2 and which communicates at the lower end thereof with one of a number of fluid passages formed in the bit mandrel 1A, disposed radially round the string axis I. In the drawing two passages, JK and EF, are shown.

In the situation shown in FIG. 1, the flow of drilling fluid is directed by the rotating deflector 4 via the passage J-K formed in the bit mandrel 1A, at the left side thereof, into annular space L-M formed between a lower extension of the bit mandrel 1A and bit carcass 1B. From the annular space L-M the drilling fluid flows via a distribution chamber I-N into the nozzles 5. As the flow passes through the annular space L-M it generates a hydrodynamic outward radial force on the carcass 1B in the direction of the arrow. This force induces the bit carcass 1B to pivot round the ball-shaped thrust bearing 6, thereby placing the spherically-shaped elastomer or other support bearing 7 in shear.

If a curved borehole section is to be drilled, the rotation of the shaft 10 is controlled in such a way that, as the drill string rotates, the flow deflector 4 rotates relative to the drill string 2 in opposite direction, at the same speed, so that the passage Q, formed inside the rotating deflector 4, is kept in a fixed orientation relative to the fixed reference direction described above. This maintains the bit axis II in a constant orientation relative to the fixed reference direction during the whole of the string rotation and therefore allows the bit to drill the borehole in a preferred direction. If the rotating deflector 4 is not rotated relative to the drill string, or rotated at a speed unrelated to the rotational speed of the drill string, then the assembly will tend to drill straight ahead, especially if the drill string is well-stablized further up the hole.

In the situation shown in FIG. 2, flow channel Q in the rotating flow deflector 4 discharges into the fluid passage E-F at the right side of the bit mandrel 1A. Thus the flow of drilling fluid is directed into the annular space G-H between the bit mandrel 1A and bit carcass 1B, thereby generating a hydrodynamic outward radial force on the bit carcass 1B in the direction of the arrow. This force induces the bit carcass 1B to pivot round the ball-shaped thrust bearing 6, thereby placing the sphericallly-shaped elastomer support bearing 7 in shear and placing the bit carcass 1B in the tilted position shown.

In the bit shown in FIG. 2 the curvatures of the ball-shaped thrust bearing 6 and spherically-shaped support bearing 7 are selected such that the bit axis II and drill string axis I intersect at a pivot center P located below the face of the bit. This gives a stable geometry, in that when the rotation of the rotating flow deflector 4 is not related to the rotation of the drill string, i.e., not held stationary relative to a reference direction, the axis II of the bit will tend to be in line with the axis I of the drill string if weight-on-bit is applied. This will tend to make the assembly drill straight ahead.

Figure 3:
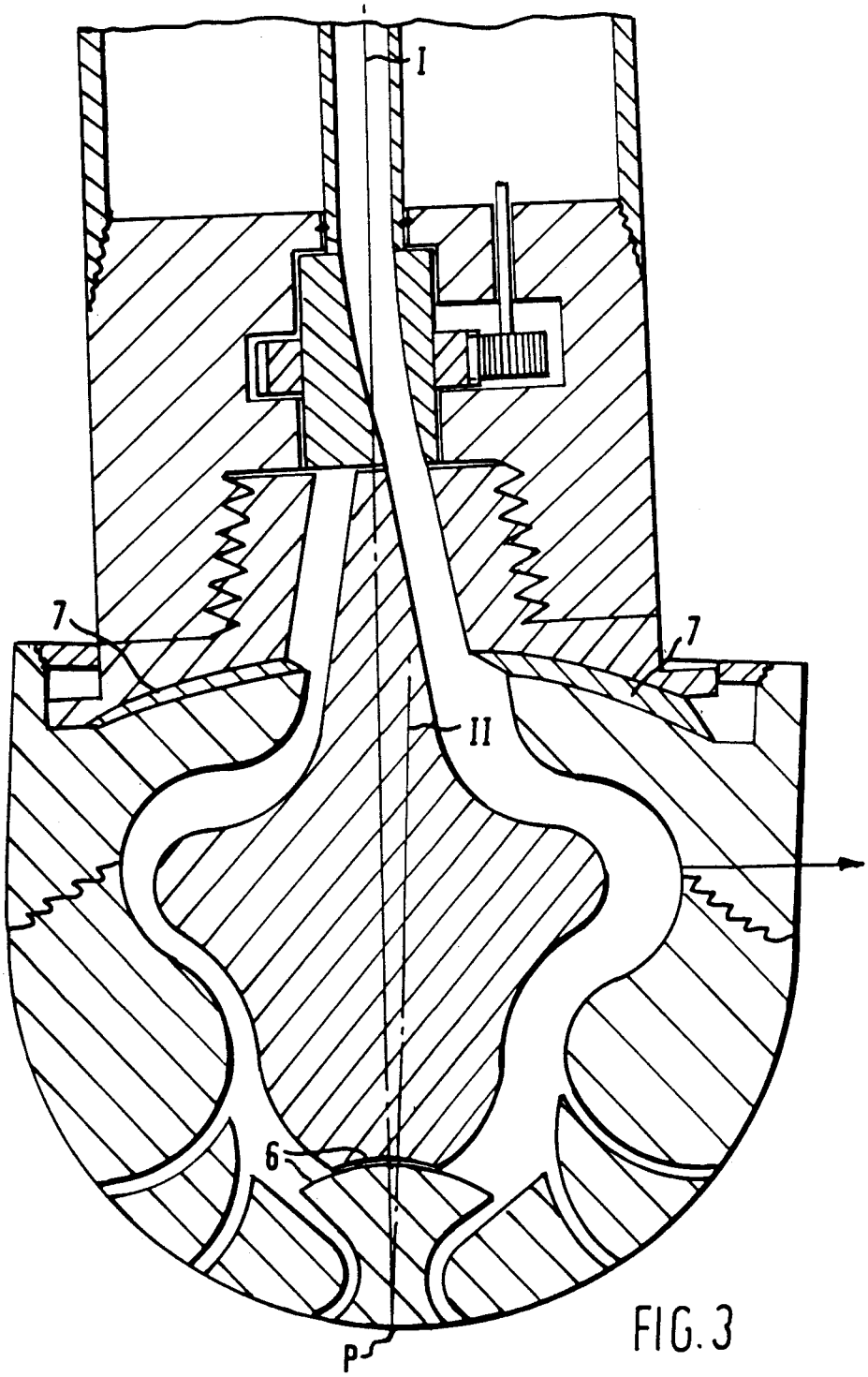
FIG. 3 is a cross sectional view of a bit with a pivot assembly having a pivot center at the bit face.

The bits shown in FIG. 3 and 4 are substantially similar to the bit shown in FIG. 1 and 2, but in these bits the geometry of the bearing assembly differs from the bearing geometry in the bit of FIG. 1 and 2.

In the bit of FIG. 3, the curvatures of the ball-shaped thrust bearing 6 and spherically-shaped support bearing 7 are selected such that the bit axis II and drill string axis I intersect at a pivot center P located at the face of the bit. This provides a neutral stability i.e. if weight-on-bit is applied the bit carcass 1B will not tend to obtain a concentric position nor will it tend to obtain a tilted position relative to the drill string.

In the bit shown in FIG. 4, the curvatures of the ball-shaped thrust bearing 6 and spherically-shaped support bearing 7 are selected such that the bit axis II and drill string axis I intersect at a pivot center P located above the face of the bit. This bit configuration is unstable, and if weight-on-bit is applied the axis II of the bit will tend always to be at a slight angle to the axis I of the drill string when bit weight is applied. The maximum angle between the bit axis II and the string axis I is constrained by the stops 8 mounted at the upper rims of the bit carcass.

If desired the rotating flow deflector or other device for generating the steering forces required to position the axis of the drill string and the axis of the bit at a varying or constant angle may also be located in the bit or in a drill string member located at a distance above the bit, as may be all or part of the bearing assembly.

As a special case if the center flow channel Q through the rotating flow deflector is spiralled then the mud flow will tend to rotate the flow deflector in the desired direction. If the spiral is extreme then the pulser will have to be restrained from rotating too fast. In a special case the required braking may be obtained by using an electrical generator on the shaft, rather than a motor. The braking may be done by electrically loading the generator, which may also provide power for the sensing systems, associated electronics, and charging a battery. Alternatively a hydraulic pump may be used as a braking mechanism.

In the steerable drilling assemblies shown in FIGS. 5–8 the steering mechanism and bearing assembly are both located in the drill string above the bit.

Referring to FIG. 5, there is shown a drill string 20 carrying at the lower end thereof a conventional drill bit 21. The drill string 20 is provided with one or more stabilizers 22 for centralizing the string in a borehole (not shown). The drill string 20 comprises an instrument sub 23 containing measuring and control equipment and above said sub 23 a section containing a mud phase generating valve 24 for telemetering data gathered by instruments in said sub 23 to the surface. The instrument sub 23 further contains the motor or generator 25 for controlling the speed of rotation of a rotating flow deflector 26 mounted in the lowermost drill string section. The lowermost drill string section is a heavy drill collar 27 consisting of an upper and a lower collar part 27A and 27B, respectively, which parts are interconnected by a spherically-shaped elastomeric or other bearing 29. The bearing allows the lower collar part 27B to pivot relative to the upper collar part 27A about a pivot point 30. Stops (not shown) may be provided to limit the angle between bit axis II and string axis I and/or to take tension loads when pulling on a stuck bit.

A flow diverting element 31 is rigidly secured to said upper collar part 27A by means of a series of radial ribs 33. The flow diverting element 31 divides the interior of the drill string just below the rotating flow deflector 26 into several flow channels of which two, 34 and 35, are shown. These flow channels 34 and 35 debouch into an annular chamber 36, 37, which is formed between the inner wall of the lower collar part 27B and the lower part of the flow diverting element 31. In the situation shown in FIG. 5, the flow channel 40 formed inside the rotating flow deflector 26 discharges into the left flow channel 34 so that the hydrodynamic pressure of the drilling fluid flowing through the interior of the drill string to the nozzles of the drill bit, inflates the annular chamber 36, 37 at the left side 36 thereof, thereby exerting an outward radial force in the direction of the arrow to lower collar part 27B, which force induces said lower part 27B and the bit 21 connected thereto to pivot about pivot point 30 toward a tilted position relative to the upper collar part 27B so that the bit axis II obtains the tilted position shown relative to the string axis I.

If during drilling the rotating flow deflector 26 rotates at such a speed relative to the drill string 20 that the rotating flow deflector 26 is stationary relative to a fixed reference direction then a curved borehole section will be drilled. If the flow deflector 26 rotates at a different speed, so that during each rotation of the drill string 20 the flow of drilling fluid inflates randomly the left and right part chamber 36 and 37 of the annular chamber then a substantially straight section will be drilled in the direction of the string axis I.

The construction of the steerable drilling assembly shown in FIG. 6 is substantially similar to that of the assembly in FIG. 5, but in the assembly of FIG. 6, the flow diverting element 50 is rigidly connected to the lower collar part 51B by means of a series of ribs 53 and protrudes into the upper collar part 51A of the drill collar 51. In the situation shown in FIG. 6, the flow channel formed inside the rotating flow deflector 54 debouches into the right side of an annular chamber 55 created between the flow diverting element 50 and the upper collar part 51A. The hydrodynamic pressure of the drilling fluid flowing through the annular chamber 55 exerts a force on the element 50 in the direction of the arrow thereby putting the spherically-shaped elastomeric bearing 56 into shear and inducing the bit 52 to pivot about the pivot point 57 so that the bit axis II obtains the tilted position shown relative to the drill string axis I.

In the steerable drilling assembly shown in FIG. 7, the drill collar 60 mounted at the lower end of the drill string 68 comprises a steering device according to the invention. The collar 60 consists of an upper and a lower collar part 60A and 60B, respectively, which parts are interconnected by a spherically-shaped elastomeric bearing assembly 61 which allows the lower collar part 60B and the bit 70 connected thereto to pivot about pivot center 63 relative to the upper collar part 60A so that the bit axis II may obtain the tilted position shown relative to the drill string axis I.

The lower collar part 60B comprises a tubular extension 64 which protrudes into the upper collar part 60A and is connected to a tubular element 65 mounted inside the upper collar part 60A by means of a flexible membrane 66. The tubular element 65, the membrane 66 and the tubular extension 64 form a continuous fluid passage for passing drillings fluid from the interior 67 of the drill string 68 to the nozzles 69 of the bit 70.

In the annular space 71 surrounding said element 65, membrane 66 and extension 64, a moineau motor section 72 is arranged, of which the stator 72A is connected to the upper collar part 60A and the rotor 72B rotates round the tubular extension 64 of the lower collar part 60B. The annular space 71 is at the upper end thereof connected in fluid communication with the interior 67 of the drill string 68 by a fluid inlet 73 in which a valve 74 is arranged. A radial fluid outlet conduit 75 provides fluid communication between the exit of the moineau motor 72 and the pipe-formation annulus 78. If the valve 74 is closed then the rotor 72A of the moineau motor section 72 has no excentric motion relative to the drill string. If the valve 74 is opened a pressure difference is created between the inlet 73 and outlet conduit 75 which causes the rotor 75B of the moineau motor 72 to rotate round the tubular extension 64 thereby obtaining an excentric rotation of the tubular extension 64 relative to string axis I. This motion of the rotor 72B puts the elastomeric bearing 61 into shear thereby inducing the bit 70 to pivot center 63 so that the bit axis II obtains the tilted position shown.

By rapidly opening and closing the valve 74 in a controlled manner during each rotation of the drill string 68 and synchroneously with the speed of rotation of the string 68, the bit axis II may be maintained in a fixed orientation relative to a reference direction and the bit 70 will drill a curved borehole section. By keeping the valve 74 closed or by opening and closing it randomly, the bit will drill straight ahead in the direction of the string axis I.

The valve 74 is controlled by electronics mounted in the annular space 71. A sensing system (not shown) senses the orientation of the bit axis II relative to the drill string axis I and also the direction of the fixed reference direction. This information is used by the electronic control system to determine when the valve 74 should be operated, as the drill string rotates.

When the valve 74 is shut the moineau motor rotor 72B is stationary. The apparatus may be designed so that when the motor rotor 72B is stationary in a specific orientation the bit axis II is coincident with the string axis I. When the motor rotor 72B is in this specific orientation the assembly will drill straight ahead with optimum efficiency. When drilling the curved section of the borehole the bit axis will tend to gyrate about the planned hole axis perhaps causing a slight loss of drilling efficiency.

If however the apparatus is so designed that, at any orientation of the motor rotor 72B the magnitude of the angle between the bit axis II and the string axis I is constant, then the drilling of curved sections of the borehole will be optimum, while straight sections might be drilled less efficiently due to bit wobble.

FIG. 8 shows a steerable drilling assembly comprising a spherically-shaped elastomeric bearing 80 and a moineau motor section 81 mounted in the lower drill collar 82B. Near the top of the collar 82, a valve 95, and seat 86, controlled by an actuator 84 are arranged. The valve 95 allows or restricts flow of drilling fluid from the interior 83 of the drill string into the bore 85 below the bypass vanes 93. The motor section 81 is arranged in an annular space 87 which surrounds a tubular extension 88 of the lower collar part 82B and a tubular element 89 and tubular membrane 90 mounted inside the upper collar part 82A.

The annular space 87 is at the upper end thereof in fluid commumication with the drill string interior 83 above the valve 95 by means of a shunt conduit 91. The annular space 87 is at the lower end thereof in fluid communication with interior of the tubular extension 88 of the lower collar part 82B by means of a port opening 92 formed in the wall of said extension 88.

If the valve 95 is in the open position thereof then the drilling fluid flows from the interior 83 of the drill string into the bore 85 through collar 82, so that the moineau motor section 81 is not activated and the axis II of the bit 93 remains concentric with the axis I of the drill string. If the valve 95 is in the closed position thereof, then the drilling fluid flows via the shunt conduit 91 into the annular space 87, thereby activating the rotor of the moineau motor section 81 to rotate and to obtain an excentric rotation which causes the lower collar section 82B and the bit 93 connected thereto to pivot such that the bit axis II is rotated relative to the string axis I. By vibrating the valve 95 such that it is closed during a selected interval of each rotation of the drill string, the bit 93 will be induced to drill a curved hole section, whereas if the valve 95 is kept open or is opened and closed randomly during each rotation of the string, the bit will drill straight ahead.

It will be understood that instead of using a hydrodynamically actuated steering mechanism for varying the bit axis relative to the string axis through a small angle during the course of each bit rotation other steering mechanisms may be used as well. For example piezoelectric, electromechanic, electrostatic mechanisms are suitable for the purpose. The rotating motion of the bit relative to the lower end of the drill string may also be generated by a downhole motor or turbine mounted in the drill string above the bit.

A suitable embodiment of the steering control system is shown in the block-scheme of FIG. 9. In the scheme it is illustrated how bit azimuth A, bit inclination I and speed of rotation of the bit, measured by a directional sensor package DSP, are transmitted to a downhole telemetry unit DTU mounted in an instrument sub above the bit. A steering direction control signal S is provided by a surface telemetry unit STU in response to the azimuth/inclination measurement A, I, which signal S is, together with the measured rotational speed, fed to the steering direction controller SDC. The steering direction controller SDC, such as the rotating flow deflectors 4, 26, 54 of FIGS. 1–6 or the valve means 74, 95 of FIGS. 7, 8 subsequently actuates the steering force generator SFG and universal pivot mechanism UPM to steer the bit in the desired direction.

Instead of using elastomeric and/or thrust bearings, other bearing assemblies or configurations may also be used for the universal pivot mechanism. The bit or lower drill string end may, for example, comprise a flexible section reinforced by carbon fibers, glass fibers or kevlar composites. The flexibility of this section should be sufficient to enable the steering mechanism to induce the axis I of the bit to pivot in a rotary mode relative to the axis II of the drill string during the course of each bit rotation, at least during those periods of drilling operations where a curved borehole section is to be drilled.

It will be further understood that the elastomer or other bearings 29, 56, 61 and 80 shown in FIGS. 5, 6, 7 and 8 may have their centers of rotation positioned below the bit face, at the bit face, or above the bit face, in a similar manner to the devices shown in FIGS. 2, 3 and 4, respectively. If spherical elastomer bearings are used, as shown in the drawing, the bearing assemblies may comprise radial reinforcement due to the torque transferred via the drill string to the bit during drilling.

It will be further understood that the moineau motors 72 and 81, shown in FIGS. 7 and 8, can also be used to generate electricity to power the electronic control and measurement systems.

Various other modifications of the present invention will become apparent to those skilled in the art from the foregoing description and accompanying drawings.

Such modifications are intended to fall within the scope of the appended claims.

What is claimed is:

1. Method of directionally drilling a borehole using a drilling assembly including an apparatus having an upper section with a longitudinal axis, and a lower section having a central axis and including at least part of a rotary drill bit, said sections being interconnected by a universal pivot mechanism, the method comprising rotating the assembly in such a manner that the upper section rotates with the drill string about said longitudinal axis and the lower section rotates about said central axis to drive the rotary drill bit and, simultaneously, during at least part of the drilling operations, tilting said lower section and rotating it in an orbital mode relative to said longitudinal axis at an equal speed and opposite direction from the rotation of the rotary drill bit, thereby orbiting the lower section about the longitudinal axis such that a plane defined by the longitudinal axis and the central axis of the tilted lower section is maintained in a predetermined orientation relative to a reference direction.

2. The method of claim 1, wherein said tilting of said lower section induces said central axis to obtain an inclined position relative to the direction of the lower end of the borehole, thereby causing cutting elements mounted on the bit to cut sideways relative to said borehole direction and to drill a borehole section with a curved path.

3. The method of claim 2, wherein during selected periods of the drilling operation the central axis of the lower section is maintained concentric with the longitudinal axis of the upper section.

4. A method of directionally drilling a borehole using a drilling assembly including an apparatus having an upper section with a longitudinal axis, a lower section having a central axis and including at least part of a rotary drill bit, said sections being interconnected by a universal pivot mechanism, the method comprising:

rotating the drilling assembly in such a manner that the upper section rotates with the drill string about said longitudinal axis and the lower section and the drill bit rotate about said central axis;

tilting said lower section and rotating it in an orbital mode relative to said longitudinal axis at an equal speed and opposite direction from the rotation of the rotary drill bit such that a plane defined by the longitudinal axis of the upper section and the central axis of the tilted lower section is maintained in a predetermined orientation relative to a reference direction during at least a part of the drilling operations.

5. The method of claim 4, wherein said tilting of said lower section induces said central axis to obtain an inclined position relative to the direction of the lower end of the borehole, thereby causing cutting elements mounted on the bit to cut sideways relative to said bore-hole direction and to a drill a borehole section with a curved path.

6. A method in accordance with claim 5, wherein, during selective periods of the drilling operation, the central axis of the lower section is maintained concentric with the longitudinal axis of the upper section.

7. An apparatus for directional drilling from an end of a rotating drill string, the apparatus comprising:

an upper section having a longitudinal axis and being suitable to be coupled at the lower end of the rotating drill string;

a lower section having a central axis and suitable for operable connection with a rotary drill bit;

a universal pivot mechanism interconnecting said upper and lower sections in such a manner that upon pivoting of the universal pivot mechanism during drilling, said central axis of the lower section is pivoted over a small angle relative to the longitudina axis of the upper section while the rotating drill string continues to drive the drill bit; and a steering means for rotating the lower section in an orbital mode relative to the longitudinal axis of the upper section and for simultaneously maintaining said central axis of the lower section in a predetermined orientation relative to a reference direction.

8. The apparatus of claim 2, wherein the universal pivot mechanism is comprised of a spherically-shaped elastomeric bearing element.

9. An apparatus for directional drilling from an end of a rotating drill string, the apparatus comprising:

a rotary drill bit; and a drill string member mounted above the rotary drill bit, comprising:

an upper section having a longitudinal axis and being suitable to be coupled at the lower end of the rotating drill string;

a lower section having a central axis and suitable for operable connection with a rotary drill bit;

a universal pivot mechanism comprising a spherically-shaped elastomeric bearing element interconnecting said upper and lower sections in such a manner that upon pivoting of the universal pivot mechanism during drilling, said central axis of the lower section is pivoted over a small angle relative to the longitudinal axis of the upper section; and a steering means for rotating the central axis of said lower section in an orbital mode relative to the longitudinal axis of the upper section and for simultaneously maintaining said central axis in a predetermined orientation relative to a reference direction.

10. The apparatus of claim 9, wherein the steering means comprise a flow deflector mounted rotatably in the upper section of the drill string member and a flow diverting element which is rigidly connected to said upper section and protrudes into the lower section such that between the element and the inner wall in said lower section an annular space is formed, the flow deflector comprising a flow channel which can by rotating the deflector relative to the upper section cause a rotating hydrodynamic radial force to be generated in the said annular space.

11. The apparatus of claim 9, wherein the steering means comprise a flow deflector rotatably mounted in the upper section and a flow diverting element which is rigidly connected to the lower section and protrudes into the upper section such that between the element and the inner wall of said the upper section such that between the element and the inner wall of said upper section an annular space is formed, the flow deflector comprising a flow channel which can by rotating the deflector relative to the upper section cause a rotating hydrodynamic radial force to be generated in said annular space.

12. The apparatus of claim 9, wherein the steering means comprises a moineau motor arranged in the drill string member, said moineau motor having a stator part rigidly connected to the upper section and a rotor part rotatably mounted around said extension of the lower section.

13. The apparatus of claim 12, wherein the steering means further comprise valve means for controlling the amount of fluid flowing during drilling through said moineau motor.

14. The apparatus of claim 12, wherein electromagnetic brake means are provided for controlling the speed of rotation of said rotor part relative to said extension.

15. The apparatus of claim 9, wherein at least part of the apparatus is mounted in a rotary drill bit having a bit mandrel and a bit carcass, the upper section of the apparatus being formed by the bit mandrel and the lower section of the apparatus being formed by the bit carcass.

16. The apparatus of claim 15, wherein the bit mandrel comprises an extension protruding into the bit carcass thereby forming an annular space between said extension and the interior wall of the bit carcass.

17. The apparatus of claim 16, wherein the bit mandrel and bit carcass are interconnected by a universal pivot mechanism comprising a spherically-shaped elastomeric bearing and a ball-shaped thrust bearing.

18. The apparatus of claim 16, wherein the steering means comprise a flow deflector which is rotatably mounted in the drill string above the rotary drill bit, in which a flow channel is arranged by rotating the flow deflector relative to the drill string, sequentially bringing the flow channel into fluid communication with different parts of the said annular space.

19. An apparatus for directional drilling from an end of a rotating drill string, the apparatus comprising:

a rotary drill bit comprising:

a bit mandrel;

a bit carcass operably connected to the bit mandrel; and a directional device comprising:

an upper section formed by the bit mandrel and having a longitudinal axis and being suitable to be coupled at the lower end of rotating drill string;

a lower section formed by the bit carcass and having a central axis and suitable for operable connection with a rotary drill bit;

a universal pivot mechanism interconnecting said upper and lower sections in such a manner that upon pivoting of the universal pivot mechanism during drilling, said central axis of the lower section is pivoted over a small angle relative to the longitudinal axis of the upper section; and a steering means for rotating the central axis of said lower section in an orbital mode relative to the longitudinal axis of the upper section and for simultaneously maintaining said central axis in a predetermined orientation relative to a reference direction.

20. The apparatus of claim 19, wherein the bit mandrel comprises an extension protruding into the bit carcass thereby forming an annular spacing between said extension and the interior wall of the bit carcass.

21. The apparatus of claim 20, wherein the bit mandrel and bit carcass are interconnected by a pivot mechanism comprising a sperically-shaped elastomeric bearing and a ball-shaped thrust bearing.

22. The apparatus of claim 19, wherein the steering means comprise a flow deflector which is rotatably mounted in a drill string section above the bit, in which deflector a flow channel is arranged which can by rotating the deflector relative to the drill string be brought sequentially in fluid communication with different parts of the said annular space.

23. The apparatus of claim 22, wherein the rotating flow deflector is connected to a motor which is able to rotate the flow deflector relative to upper section at such a speed that the flow deflector is substantially stationary relative to a fixed reference direction.

24. The apparatus of claim 23, wherein the flow deflector comprises a spiralling flow channel which is shaped in such a way that the deflector is rotated by the fluid flowing through the channel and braking means are provided for controlling the speed of rotation of the flow deflector relative to said section.

25. The apparatus of claim 24, wherein the braking means consists of an electrical generator.

26. The apparatus of claim 24, wherein the braking means consists of an hydraulic pump.

27. An apparatus for directional drilling with a rotary drill bit from an end of a rotating drill string, the apparatus comprising:

an upper section having a longitudinal axis and being suitable to be coupled at the lower end of the rotating drill string;

a lower section having a central axis and suitable for operable connection with the rotary drill bit;

a universal pivot mechanism comprising a spherically-shaped elastomeric bearing element interconnecting said upper and lower sections in such a manner that upon pivoting of the universal pivot mechanism during drilling, said central axis of the lower section is pivoted over a small angle relative to the longitudinal axis of the upper section; and a steering means for rotating the central axis of said lower section in an orbital mode relative to the longitudinal axis of the upper section and for simultaneously maintaining said central axis in a predetermined orientation relative to a reference direction.

28. The apparatus of claim 27 wherein the steering means comprises a flow deflector mounted rotatably in the drill string and a flow diverting element which is rigidly connected to said upper section and protrudes into the lower section such that an annular space is formed between the flow diverting element and the inner wall of said lower action, the flow deflector comprising a flow channel which is effective to cause a rotating hydrodynamic radial force to be generated in the said annular space by rotating the flow deflector relative to the upper section.

29. The apparatus of claim 28, wherein the steering means comprises a moineau motor arranged in said annular space, said moineau motor having a stator part rigidly connected to the upper section and a rotor part rotatably mounted around an extension of the lower section.

30. The apparatus of claim 29, wherein the steering means further comprise valve means for controlling the amount of fluid flowing through said moineau motor during drilling.

31. The apparatus of claim 28 wherein the rotating flow deflector is connected to a motor which is able to rotate the flow deflector relative to upper section at such a speed that the flow deflector is substantially stationary relative to a fixed reference direction.

32. The apparatus of claim 27, wherein the steering means comprises a flow deflector rotatably mounted in the upper section, and a flow diverting element which is rigidly connected to the lower section and protrudes into the upper section such that an annular space is formed between the flow diverting element and the inner wall of said upper section;

the flow deflector defining a flow channel effective to generate a hydrodynamic radial force in the said annular space by rotating the flow deflector relative to the upper section.

* * * * *